United States Patent [19]

Thiel et al.

[11] Patent Number: 4,477,791

[45] Date of Patent: Oct. 16, 1984

[54] SPACER BLOCK PATTERN FOR ELECTRICAL INDUCTIVE APPARATUS

[75] Inventors: Patrick L. Thiel; Clifford F. Lawry, both of Muncie; John G. DeNeef, New Castle, all of Ind.

[73] Assignee: Westinghouse Electric Corp., Pittsburgh, Pa.

[21] Appl. No.: 437,374

[22] Filed: Oct. 28, 1982

[51] Int. Cl.[3] ..... H01F 27/08

[52] U.S. Cl. ..... 336/60

[58] Field of Search ..... 336/60, 185, 207, 55, 336/57, 58

[56] References Cited

U.S. PATENT DOCUMENTS

| | | | |
|---|---|---|---|
| 834,160 | 10/1906 | Nichols | 336/185 X |
| 1,143,305 | 6/1915 | Nichols | 336/60 X |
| 1,156,680 | 10/1915 | Fortescue | 336/60 |
| 2,155,840 | 4/1939 | Rorden | 336/185 X |
| 3,032,728 | 5/1962 | Camilli et al. | 336/60 |
| 3,151,304 | 9/1964 | Miller | 336/60 X |
| 3,391,363 | 7/1968 | Moore | 336/60 X |
| 3,500,272 | 3/1970 | Campbell et al. | 336/60 |
| 3,602,857 | 8/1971 | Robin | 336/60 |
| 3,602,858 | 8/1971 | Moore | 336/60 |
| 3,668,584 | 6/1972 | Robin et al. | 336/60 |

FOREIGN PATENT DOCUMENTS

| | | | |
|---|---|---|---|
| 1361895 | 4/1964 | France | 336/60 |
| 54-21525 | 2/1979 | Japan | 336/60 |

*Primary Examiner*—Thomas J. Kozma
*Attorney, Agent, or Firm*—D. R. Lackey

[57] ABSTRACT

A spacer block pattern for electrical inductive apparatus characterized by a plurality of pancake coils with a spacer insulating sheet washer between each adjacent pair of coils, a plurality of spaced insulating spacer blocks on opposite sides of the washer and in surface abutment with the corresponding adjacent coil, the spacer blocks on all of the washers being in alignment with each other and disposed on the locating lines reference to the core center.

5 Claims, 6 Drawing Figures

SPACER BLOCK PATTERN FOR ELECTRICAL INDUCTIVE APPARATUS

BACKGROUND OF THE INVENTION

1. Field of the Invention

This invention relates to fluid cooled electrical inductive apparatus and, more particularly, to a pattern for spacer blocks disposed between adjacent electrical coils in the core coil assembly.

2. Description of the Prior Art

Electrical inductive apparatus, such as transformers and reactors of the shell-form type, include one or more windings, each formed of a plurality of serially connected pancake type coils. Such coils are disposed in spaced side-by-side relation, separated by insulating spacer washers. Each spacer washer includes an insulating sheet having a plurality of rectangular insulating blocks attached thereto with a suitable adhesive. When assembled the blocks are in contact with the turns of the pancake coil so that the insulating sheet washer and adjacent surface of the pancake coil provide a cooling duct through which a fluid cooling dielectric, such as oil, flows. The rectangular blocks space the coil from the insulating sheet washer, they provide a plurality of paths through which the fluid coolant flows, and they support the turns of the pancake coil to prevent them from being deformed due to short circuit forces. The placement and gluing of the rectangular blocks on the insulating sheet washer is time consuming and costly.

Another disadvantage of prior procedures was that no reference point was used for insuring exact alignment of all spacers on all washers within a phase regardless of washer size and washer offset.

SUMMARY OF THE INVENTION

In accordance with this invention a spacer block pattern for fluid-cooled electrical inductive apparatus is characterized by a core-coil assembly having a plurality of pancake coils with insulating sheet washers therebetween. Each washer comprises vertical and horizontal center lines that pass through the center point of the core. Each washer has a plurality of rectangularly shaped blocks extending outwardly from both sides thereof with corresponding blocks on opposite sides being aligned and with the washers on each side being in abutment with the corresponding adjacent pancake coil. The blocks are arranged in spaced rows on locating lines relative to corresponding locating lines or other washers, whereby the blocks on all washers are in substantial alignment in each corresponding position.

The advantage of the device and method of this invention is that the core center is a reference point which insures exact alignment of all strips and spacers on all washers within a phase regardless of washer size and washer offset.

DESCRIPTION OF THE PREFERRED EMBODIMENTS

Figure 1:
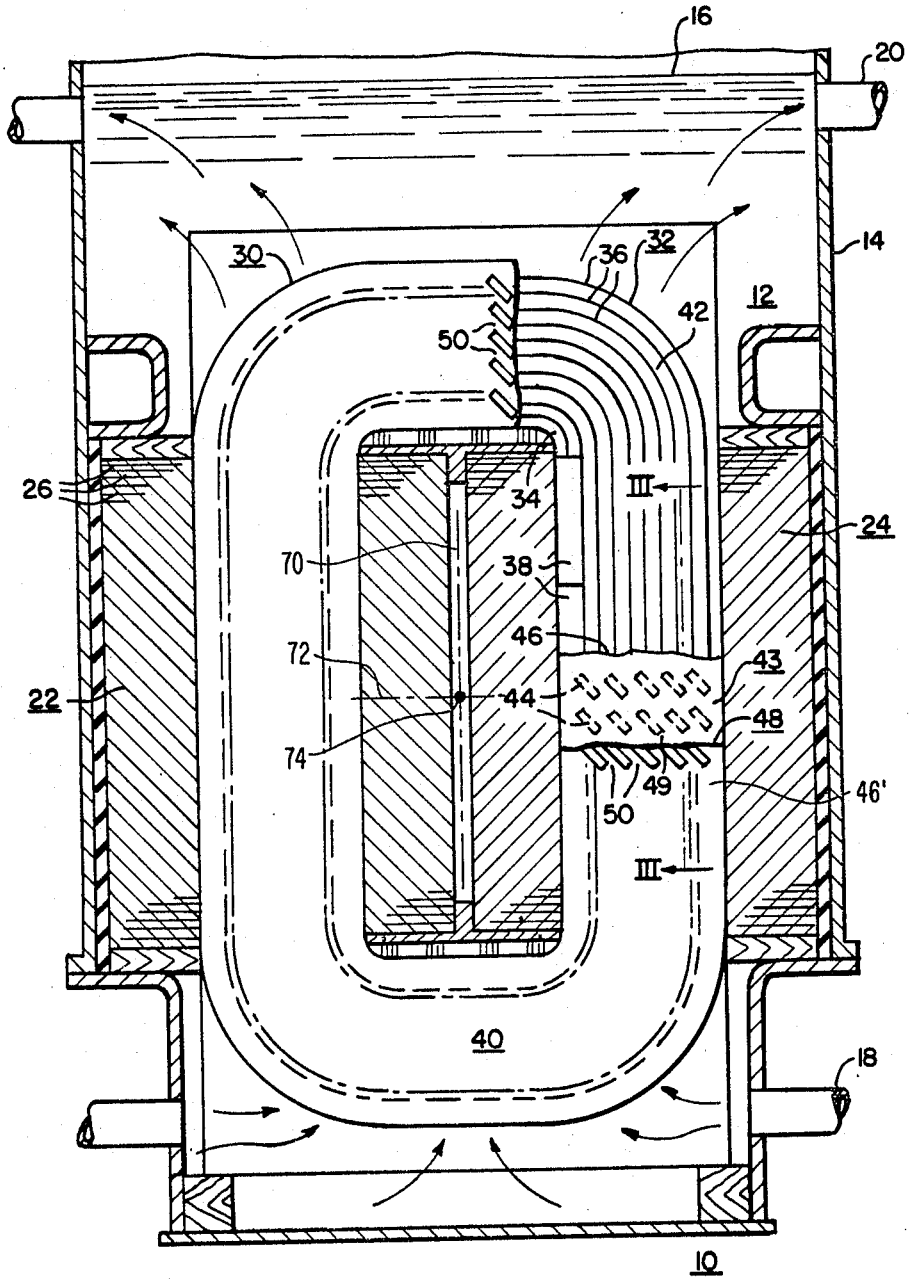
FIG. 1 is a vertical sectional view of a transformer having a coil-core assembly in accordance with this invention.

In FIG. 1 an electrical inductive apparatus is generally indicated at 10 and it may be a transformer or a reactor, having a core coil winding assembly 12 disposed within a tank or casing 14, which is filled to a suitable level 16 with a cooling and insulating dielectric fluid, such as oil. Casing 14 has suitable inlet and outlet openings 18 and 20, respectively, connected to external heat exchanger means (not shown) for circulating and cooling the dielectric fluid. The dielectric fluid is heated by the core-coil assembly 12 and rises, thus establishing a natural upward flow of the coolant, (as illustrated by the arrows in FIG. 1) due to the thermal siphon effect. Pumps (not shown) may be added to force the coolant to flow through the core coil assembly 12 and through the external heat exchanger means, if required.

The core coil assembly 12 is of the shell-form type, and may be single or polyphase. The core-coil assembly 12 includes magnetic core sections 22, 24, which comprise a plurality of stacked metallic laminations 26, formed of a suitable magnetic material, such as grain oriented silicon steel. The magnetic core sections 22, 24 are disposed in side-by-side relation, with their adjacent portions forming a core winding leg for the winding assembly having a longitudinal axis 74. Core coil assembly 12 also includes a winding assembly, generally indicated at 30, which is disposed in inductive relation with magnetic core sections 22 and 24. If inductive apparatus 10 is a transformer, it will include high and low voltage windings, which may be of the isolated type, or of the auto transformer type.

Electrical winding assembly 30 includes a plurality of discs or pancake-type spirally wound coils, such as pancake coil 32, which has an opening 34 for receiving the leg portions of core sections 22 and 24. The plurality of pancake coils are stacked in side-by-side relation, with their openings or windows in alignment. The pancake coils of each separate winding are serially connected with start-start, finish-finish connections, in a manner well known in the art.

Each pancake coil, such as coil 32, has a plurality of turns 36 formed of an insulated electrical conductor, such as copper or aluminum, with the conductor having one or more conductive strands, as required by the particular application. Each pancake coil has two major opposed surfaces, such as surface 42, perpendicular to core axis 74 and the opening 34, which are joined by the opening or the inner edge of the coil, and by its outer edges. As illustrated, the pancake coils are generally rectangular in shape, having four straight sections, joined by four rounded outer corners.

Each of the pancake coils has a plurality of tight fitting insulating channel members applied to both its inner and outer surfaces, to insulate and accommodate the high electrical stresses at the edges of a coil. For example, pancake coil 30 has a plurality of insulating channel members 38 applied end-to-end to completely cover its inner edges, and a plurality of insulating channel members 40 applied end to end to completely cover its outer edge. Cooling ducts adjacent the major surfaces of each pancake coil are formed by insulating washers which include a plurality of insulating spacer blocks having one surface in contact with a major surface of a pancake coil, i.e., against the conductor turns 36 of the coil, and which have their opposite surface attached to an insulating sheet member, which have the same general shape as the pancake coils.

Specifically, the major surface 42 (FIG. 1) of pancake coil 30 is cooled by a duct formed by a washer 43, which includes a plurality of spacer blocks 44 attached to a sheet-like insulating member 46, such as by gluing. The blocks 44 and insulative member 46 may be formed of any suitable insulating material, such as pressboard.

Figure 4:
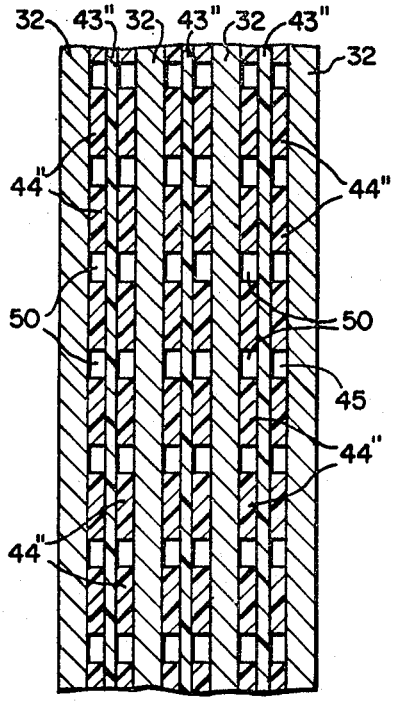
FIG. 4 is a view similar to FIG. 3 of another embodiment thereof.

The pancake coil adjacent to pancake coil 32, in the cut-away portion of the inductive apparatus 10, is cooled by ducts 50 formed by washer 48 which includes a plurality of spacer blocks 44' mounted on an insulative member 46'. The spacer blocks 44, 44' may be mounted either directly onto their respective members 46, 46', or the blocks may be mounted onto a sheet of insulating material, such as paper, which in turn is mounted onto the pressboard members 46, 46'. Spacer blocks 44 are glued to one of the major surfaces of the insulating member 46, and its other major surfaces is disposed against the major surface of a similar insulating member 46'. In the alternative, instead of disposing the major surfaces of two insulating washers 43 and 48 together, and attaching the spacer blocks to their remaining exposed major surfaces, a single insulating washer 43' (FIG. 4) may be used which includes a single insulating sheet member 43'' having a plurality of spacer blocks 44'' attached to both of its major opposed surfaces.

In accordance with this invention it has been found that the orientation and pattern of the spacer blocks 44 on the insulating members 46 within a transformer phase eliminates potential failure due to short circuit forces. The pattern consists of individual spacer blocks 44 and 44' applied to the insulative members 46 and 46' to provide the necessary support of the pancake coils 32, and to define duct spaces 45 and 50 to remove heat from the current carrying coils. All pancake coils within a phase are in contact with spacer blocks 44 and 44' arranged with the spacer block pattern shown in FIG. 2. For example, the location of the spacer blocks 44 is controlled by a series of locating lines and set-back lines.

Figure 2:
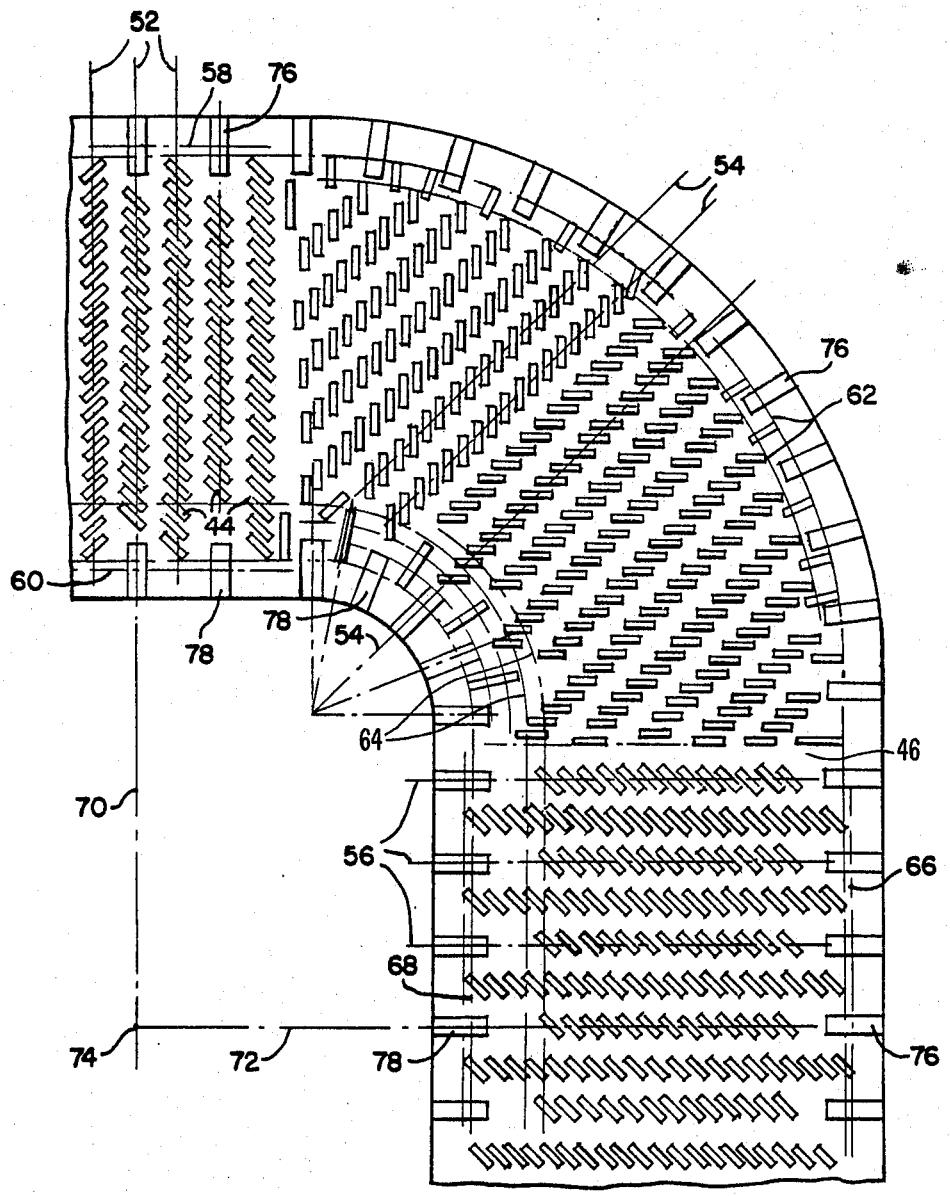
FIG. 2 is an enlarged fragmentary view of a spacer washer showing the spacer block design in accordance with this invention.

As shown in FIG. 1, each pancake coil 32 has four quarter sections of like configuration, with FIG. 2 illustrating the upper right-hand quarter section. Each quarter section includes a curved corner portion, the ends of which are joined by straight end and leg portions which are respectively horizontally and vertically oriented. Each block has a geometric center, and a longitudinal axis or center line which extends through its center. The various locating lines associated with the rows pass through the centers of the blocks. Locating lines 54 of the curved portion are oriented 45 degrees relative to horizontally oriented locating lines 56 of the leg portion, and relative to vertically oriented locating lines 52 of the end portion. The set-back lines in the end portion include a pair 58 of closely spaced outer set-back lines and a pair 60 of closely spaced inner set-back lines. The set-back lines in the curved portion include a pair 62 of closely spaced outer set-back lines, and a pair 64 of closely spaced inner set-back lines. The set-back lines in the leg portion include a pair 66 of closely spaced outer set-back lines, and a pair 68 of closely spaced inner set-back lines. Vertical and horizontal center lines 70, 72 of the core leg intersect at the core longitudinal axis 74.

Figure 3:
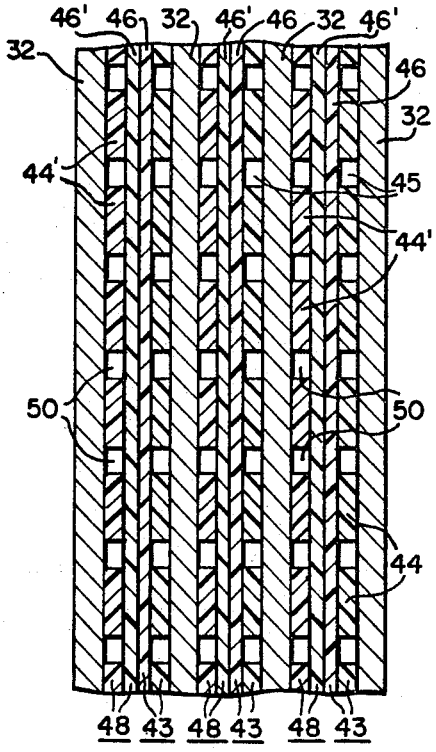
FIG. 3 is a fragmentary sectional view taken on the line III—III of FIG. 1.

By using the core center 74 as the reference point for each washer, the locating lines coincide in exactly the same positions for all washers 43, 48, for which reason all the rows (FIGS. 3, 4) are in exactly the same position on all washers 43, 48. Thus, the rows of blocks 44' in corresponding positions on opposite sides of each washer and of all washers are in alignment.

The spacer blocks 44' which are positioned on their respective locating lines have similar dimensions, such as one-half inch wide, one and three-quarters inches long, one-quarter inch thick, and are glued into place as shown. The spacer blocks 44 are set at a 45 degree angle to their respective locating lines to provide a one-quarter inch oil duct between adjacent blocks 44. The positions of spacer blocks 44 and 44' are controlled by a pair of set-back lines at each end of their associated locating line.

As shown in FIG. 2 the spacer blocks are disposed in spaced rows. The rows for the leg (vertical) portion of the washer are horizontally disposed in rows of long and short lengths with the longer row being disposed between the outside and inside set-back lines 66, 68. The shorter rows of blocks are disposed between edge spacer blocks 76, 78 the outer ends of which are aligned with the outer and inner edges of the washer. Similarly, the spacer blocks 44 in the corner portions of the washer are disposed in alternately longer and shorter rows with edge spacers 76, 78 extending into the areas not occupied by the shorter rows of blocks. In the segment of the corner rows of blocks adjacent the leg or vertical portion of the washer the blocks 44 are disposed horizontally, while the blocks in the other segment of the corner adjacent the horizontal portion of the washer are disposed vertically.

By placing the several spacer blocks 44 at angles to their locating lines 52, 54 and 56, the coolant fluid or oil moves from the interior of the coil-core assembly outwardly through the spaces between the adjacent rows of spacer blocks as well as through the ducts formed between each pair of blocks. Thus, the surfaces of the pancake coils are subjected to cooling by the coolant flow.

Figure 5:
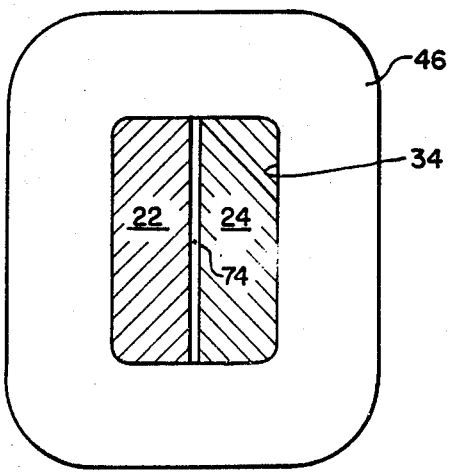
FIG. 5 is an illustration of the assembly of the coil and core of most of the coil windings.

As shown in FIG. 5 the insulating sheet member 46 of washer 43 is disposed around leg portions of the magnetic core sections 22, 24 which occupy the opening 34 of the washer. Most of the washers of the core-coil assembly 12 are similarly disposed as shown for the high voltage winding group with the washer centers coinciding with the core center or axis 74.

Figure 6:
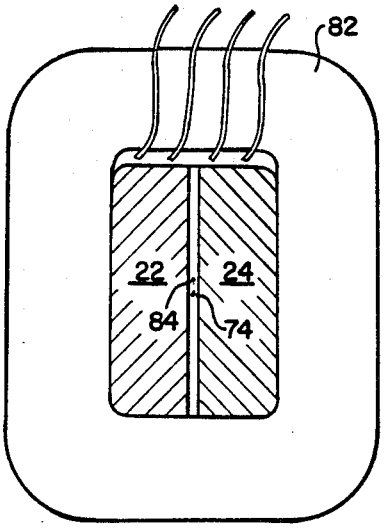
FIG. 6 is an illustration of a core-coil assembly, one of the coil windings having tap changing leads extending therefrom.

Where, however, for another winding group low voltage, or tertiary voltage, as shown in FIG. 6, the center point 84 of the washer 82 is disposed above the center point 74 of the core and coil assembly 12. However, all locating lines before placing the spacer blocks 44 on the washer 82 coincide with similar lines for adjacent sheet members 46. Accordingly, the rows of spacer blocks 44 on the washer 82 are in alignment with corresponding rows of spacer blocks on all other washers.

In conclusion, the spacer blocks in conjunction with appropriate locating and set-back lines are positioned on a washer to eliminate all body adjustment blocks. By using the core center as a reference point the pattern of the spacer blocks insures exact alignment of all rows on the washer within a phase regardless of the washer size and washer offset. Moreover, the block width to oil duct width ratio is two for the spacer blocks which sets the maximum mis-alignment possible of 50 percent for the blocks on one washer to that of an adjacent washer. This compares with the theoretical limit of 100 percent misalignment for standard block patterns. The disclosed pattern therefore reduces phase compression under short circuit forces. In addition, a number of items required, such as strips or individual blocks, to support a coil is reduced by 60 percent as compared with conventional spacer block patterns. In addition, the percent coil blanketing at the washer end, leg and corner is uniform allowing for even phase compression under short circuit forces. Offset positioning of the strips in the leg, corner, and end portions directs the oil flow, under natural thermosiphon or forced oil condition, toward the inside of the washer where it is most needed to improve convective heat transfer thereby reducing coil hot spots. By providing close strip spacer spacing, elimination of body adjustment blocks and minimal quantity of secondary edge spacer blocks permits all wire strands to satisfy the maximum unsupport requirements. Finally, based on comparative tests of strip spacer pattern and standard block pattern, the strip spacer pattern has simultaneously reduced hot spots and reduced coil temperature rise above average coil temperature.

What is claimed is:

1. A winding assembly for fluid-cooled electrical inductive apparatus, comprising:

a core-coil assembly including a core leg having an axially extending core center line and a plurality of stacked pancake coils each having a plurality of conductor turns disposed about said core leg;

and at least one spacer insulating sheet washer disposed between adjacent pancake coils, each washer having upper and lower straight ends, four curved corners, and two straight leg portions coextensive with corresponding portions of the pancake coils;

each washer having a plurality of rectangularly shaped blocks having a geometric center and a longitudinal axis which extends through said centers, said blocks extending outwardly from at least one side of its associated washer and in contact with a pancake coil;

said blocks being disposed in predetermined spaced relation comprising a plurality of blocks arranged in spaced rows;

said spaced rows being vertically oriented in the upper and lower end portions, horizontally oriented in the two leg portions, and oriented at substantially a 45 degree angle in the four corner portions, the rows of each washer all being located with reference to the core center line, to align the rows throughout the stack of pancake coils, the blocks of any one row all having a like orientation, with said blocks being oriented with their longitudinal axes at substantially a 45 degree angle with respect to a line drawn through the centers of the blocks.

2. The device of claim 1 in which the rectangular blocks comprise opposite side and end walls, with the side walls of adjacent blocks being spaced to define oil ducts, with a block width to oil duct width having a ratio of two.

3. The winding assembly of claim 1 wherein the blocks in the horizontally oriented rows of the leg portions of a washer are oriented to direct coolant to the inner periphery of the washer member.

4. The winding assembly of claim 1 wherein the longitudinal axes of the blocks of certain of the 45 degree rows of the curved corner portions are horizontally oriented, and the longitudinal axes of the blocks of other such rows are vertically oriented.

5. The winding assembly of claim 1 wherein the blocks in certain of the vertically oriented rows of the upper and lower end portions are oriented 90 degrees relative to the orientation of the blocks in other of such rows.

* * * * *